US010145119B2

(12) United States Patent
Yadlowsky et al.

(10) Patent No.: US 10,145,119 B2
(45) Date of Patent: Dec. 4, 2018

(54) SHINGLE REMOVAL TOOL

(71) Applicants: Ken Yadlowsky, Lac la Biche (CA); Adam Yadlowsky, Nipawin (CA)

(72) Inventors: Ken Yadlowsky, Lac la Biche (CA); Adam Yadlowsky, Nipawin (CA)

( * ) Notice: Subject to any disclaimer, the term of this patent is extended or adjusted under 35 U.S.C. 154(b) by 0 days.

(21) Appl. No.: 13/677,506

(22) Filed: Nov. 15, 2012

(65) Prior Publication Data

US 2013/0125712 A1 May 23, 2013

Related U.S. Application Data

(60) Provisional application No. 61/561,540, filed on Nov. 18, 2011.

(51) Int. Cl.
*E04D 15/02* (2006.01)
*E04D 15/00* (2006.01)

(52) U.S. Cl.
CPC ..... *E04D 15/003* (2013.01)

(58) Field of Classification Search
CPC ..... E04D 15/02; E04D 15/003; E04D 15/04
USPC ..... 81/45; 30/169, 170; 254/131, 131.5
See application file for complete search history.

(56) References Cited

U.S. PATENT DOCUMENTS

| | | | | |
|---|---|---|---|---|
| 2,714,907 | A * | 8/1955 | Peck | 81/45 |
| 4,477,972 | A | 10/1984 | Testa, Jr. | |
| 4,809,436 | A | 3/1989 | Crookston | |
| 5,988,021 | A * | 11/1999 | Nicolosi et al. | 81/45 |
| 6,257,094 | B1 * | 7/2001 | Babich | 81/45 |
| 7,036,395 | B2 * | 5/2006 | Sapienza | 81/45 |
| 7,360,473 | B1 * | 4/2008 | Holt | 81/45 |
| 7,401,861 | B2 | 7/2008 | Purcell | |
| 7,669,506 | B2 | 3/2010 | Cox | |
| 7,992,467 | B2 | 8/2011 | Becoat | |
| 2005/0120831 | A1 | 6/2005 | Parker | |

* cited by examiner

*Primary Examiner* — David B Thomas
(74) *Attorney, Agent, or Firm* — Daniel Boudwin; Global Intellectual Property Agency

(57) ABSTRACT

A tool for removing roof shingles is disclosed having a handle, a split shaft, a pair of roller wheels and a replaceable blade member. A pair of handles extends orthogonally from the proximal end of the shaft, while the distal end of the shaft separates into a first and second portion that support a flat, shingle-removing blade. Roller wheels are positioned adjacent to the blade such that the blade and wheels can be positioned along the roof surface to allow sliding of the blade under shingles and to provide a fulcrum point from which to lift the blade from beneath any secured roof shingles during removal. The shaft upper portion may include a slight upward bend to reduce back strain, while the user handles are preferably rotatably support to allow the tool to rotate as it is slide without the handles rotating relative to the user's hands and causing blisters.

13 Claims, 5 Drawing Sheets

SHINGLE REMOVAL TOOL

CROSS REFERENCE TO RELATED APPLICATION

This application claims the benefit of U.S. Provisional Application No. 61/561,540 filed on Dec. 5, 2011, entitled "Shingle Stripper." The patent application identified above is incorporated here by reference in its entirety to provide continuity of disclosure.

BACKGROUND OF THE INVENTION

Field of the Invention

The present invention relates to a device for removing surface material from the exterior of a structure. More specifically, the present invention relates to a roof shingle removal tool comprising a rotating handle interface connected to a reinforced shaft that attaches to a serrated blade structure.

In order to ensure the longevity of erected structures, certain materials are placed on external surfaces to prevent the intrusion of exterior elements, thereby maintaining a habitable atmosphere within the confines of the structure. The most common materials known to provide this barrier of protection are asphalt shingles, roll roofing material, slate, cement, tiles, tin and wood shakes. Asphalt shingles are the most prominent material used for roofing purposes because of their rugged nature, extensive life span and low cost. In order to ensure the longevity of the roof, certain methods must be adhered to, such as overlapping the shingle sections and fastening the shingles in the correct zones. Following the correct installation methods, asphalt shingles produce an impenetrable barrier against the infiltration of the outside environment and is the main catalyst prompting homeowners to continually choose this material.

Despite the rugged nature of asphalt shingles, constant exposure to the elements over many years will eventually degrade the product, thereby causing surface granular erosion and necessitate immediate repair or replacement. This can be an expensive endeavor, which forces homeowners to proceed with less costly alternatives such as adding supplementary layers of shingles or attempting to patch the roof breach with tar or other products. However, the shingles will ultimately fail and allow the outside environment to penetrate the roof thereby causing damage to the interior of the building in the form of mold growth, structural damage and sufficient energy loss.

When shingles are installed on a roof they are placed in an successively overlapping manner forming an integrated system whereby the shingles installed closer to the peak of the roof supply additional downward pressure normal to the roof line relating to the shingles installed at lower altitude. In order to physically secure the shingles to the roof, roofing nails are approximately installed along the center seem of the shingle section. These fasteners are made with an oversized head that allows for a larger striking surface as well as additional surface area to compress the shingle to the roof. Although these nails penetrate the roof and thereby the interior substrate they do not allow for any water intrusion due to their placement along the top seem of the shingle. The subsequently installed shingle section will cover the nails thereby providing support and shielding the nails from the environment.

Removing shingles from a roof creates a situation containing numerous safety hazards that must be addressed prior to performing any work. Safety harnesses are used to negate injury from falling off of the roof while buckets attached to ropes are utilized to safely transport necessary tools in lieu of carrying them while on a ladder. In order to perform this task as safely as possible a user should utilize tools that are lightweight and easy to handle, due to the fact that bulky equipment ensures instability while handling and therefore proposes an imminent danger to workers. Pry bars are often deployed to remove shingles due to their popularity in the construction field yet they offer limited assistance. The inadequate contact surface area supplied by the pry bar provides a scarce amount of leverage when deployed underneath a shingle and requires a user to expend more energy to detach the shingle from the roof. Another drawback of a pry bar involves the constant bending over while extraneously lifting shingle sections, providing an opportunity for serious back injuries to occur.

The present invention is a tool reduces exertion of a worker removing surface treatments and roofing shingles from a surface. The device is operable while the user is in the standing position, with the geometry of the shaft preventing crouching or bending at the waist and thus reduces back pain over an extended period of use. The shaft and two roller wheels of the device allow the user to negotiate the tool beneath roofing shingles, allowing the user to forcibly plow forward with the tool blade or lift the shingles using the roller wheels as a fulcrum point. Once a downward force is applied by a user at the handle end of the tool, the blade transfers a lifting force from beneath a shingle to lift and separate the shingle from the roof. The wheels act as a means of sliding the blade, while also provide a fulcrum point to supply significant leverage to separate roofing material for collection or disposal. The handles are further rotatable about the tool to prevent rubbing and friction burns on the user's palms and fingers.

DESCRIPTION OF THE PRIOR ART

The present invention addresses the prominent shortcomings relating to shingle removal devices that commonly reside in the art. The majority of devices in the art contain similar methods for detaching and removing the unwanted shingles, which commonly requires a user to insert a rigid blade underneath the shingle before applying a downward force thereby separating it from the roof. The efficiency of this repetitive action and safety relating to a user performing the task are the ideal categories where improvements are both needed and justified. Devices that require the use of two hands for deployment and bulky or heavy systems detract from the overall stability of a user while operating the tool, thereby adding opportunities for tragic accidents to occur, especially in the highly elevated work environment where these tools are used. Some devices require a user to continually bend below the waste to deploy the tool which after several cycles can cause back pain and thereby further distract a user from completely focusing on the task at hand putting themselves at risk of losing their balance. The present invention addresses these shortcomings with a device that is deployed while remaining in the standing position, provides a rotatable handle device to reduce hand injuries and a structure that decreases the amount of force needed to situate the device underneath the designated shingles for forcible removal thereof in a sliding or lifting manner. Therefore, the present invention differs dramatically in both structure and spirit from devices currently found in the art and is ideally suited for personal use when a user has a need for removing shingles. The following devices are the most prevalent in the prior art relating to shingle removal tools.

U.S. Pat. No. 7,992,467 to Becoat is one such device in the art that relates to a shingle removing tool comprising a handle, a stripper member, a drive assembly and a drive linkage assembly. The stripping member is inserted under the section of shingles targeted to be removed, prompting the drive mechanism to be activated propelling the stripping member further underneath the shingle producing an upward force thereby removing it from the roof. Although this disclosure provides less energy in order to remove shingles several important drawbacks are immediately apparent. By utilizing a drive assembly and linkage several more points of failure are added to the assembly when compared to passive devices. Also, the added weight may prove to be a safety hazard while being deployed on a roof where heavier objects prove to interfere with maintaining balance.

U.S. Pat. No. 7,669,506 to Cox is another device that describes a means to remove shingles comprising a handle, an adjustable shaft and a base containing a blade for prying up shingles. A variety of additional embodiments accompany this invention including a T-handle, a pivoting blade, and several different support handles to aid in deploying the device. This device relies on a pin joint to fix the pivoting blade which acts as the inherent fulcrum instead of the frame itself producing a point of failure due to inadequate rigidity. Furthermore, the dual frame of the present invention greatly improves stability when compared to Cox's disclosure thereby decreasing inherent safety concerns while the attached wheels of the dual frame allow for constant contact with the roof line lessening the required energy needed to situate the device. Based on these issues the present device is superior to Cox's disclosure relating to efficiency, safety and maintainability.

U.S. Pat. No. 4,477,972 to Testa and U.S. Pat. No. 4,809,436 to Crookston are additional devices that describe a means for removing shingles, comprising a handle connected to a singular shaft that terminates at a blade. Another handle is added to Testa's device acting as an additional bracing point for a user's second hand allowing maximum exertion of force throughout deployment. The blade is inserted underneath the shingles designated for removal and the bent shaft acts as a fulcrum propping up the shingles for collection or disposal. These inventions provide efficient designs but fail to meet the standards set by the present device. While utilizing a single shaft frame without wheels, both devices do not supply the necessary stability as does the present invention. Testa's invention positions one handle at the upper portion of shaft along its axis and another orthogonal to the shaft at the lower portion requiring the use of both hands to supply maximum force. Using both hands while operating the device allows for opportunities of instability that could translate into severe safety hazards. Crookston's device supplies a single handle located on the upper portion of the device providing an orthogonal grip to exert maximum force along the shaft yet the single shaft design does not provide the stability as does the present invention. The present device offers a first and second handle extending orthogonally from the tool shaft body to allow for single handed use while also including an inherent rotational capability. This functionality allows a user to maintain positive control of the device through constantly applied pressure ensuring stability throughout deployment. Wheels that reduce the required amount of effort to deploy the device, the rotatable handles reduce hand wear and the dual frame of the present invention further demonstrate improvements necessary to enhance the efficiency and stability relating to shingle removal devices currently found in the art.

U.S. Pat. No. 7,401,861 to Purcell is another device that describes a means to remove shingles comprising a shaft covered by a sleeve on one end that is connected to a clevis, a drive mechanism for shifting a rod between two distinct positions and a blade mounted to the clevis. When the drive mechanism engages to shift the rod between two dissimilar positions, the clevis will pivot on the sleeve and the sleeve will slide on the shaft proving the translation of the blade from the first position to the second which forms a lifting motion relative to the surface on which the device is deployed. A switch for the device is added to activate the drive mechanism and therefore automates the shingle removal. This device provides a novel means to remove shingles yet contains several distinct drawbacks when compared to the present invention. Utilizing a single shaft design, Purcell does not supply a stable means to remove shingles and the bulky nature of this invention may cause a user to lose balance while working on elevated sites. The complexity of this device also adds the capacity for mechanical failure and repair costs deriving from the drive mechanism, a static device such as the present invention negates these issues.

U.S. Patent Application 2005/0120831 to Goubeaux is another device that describes a means to remove shingles comprising a handle, an adjustable singular shaft relating to the angle at which the handle is positioned relative to the roof line, a pair of wheels attached to the lower section of shaft, a blade and another handle attached to the shaft for two handed deployment. This device presents a novel means to remove shingles from a roof yet contains several drawbacks when compared to the present invention. A singular shaft design as described in Goubeaux's device does not maintain the level of stability in relation to the present invention which provides a dual shaft framework. The present invention also allows for a continuous grip during use through the use of a rotatable handle, thereby preserving constant control of the device. Goubeaux's device comprises a fixed handle that does not allow for a continuous grip prompting a user to loosen their clamping force while situating the device, lessening overall control of the tool and increasing the risk for accidents.

From this brief description of prominent devices in the art it is plainly gathered that the present invention provides a novel means to remove shingles from a given surface and therefore substantially diverges in design elements from the prior art. Consequently it is clear that there is a need in the art for an improvement to existing shingle removal devices. In this regard the instant invention substantially fulfills these needs.

SUMMARY OF THE INVENTION

In view of the foregoing disadvantages inherent in the known types of shingle removal devices now present in the prior art, the present invention provides a new shingle removal device wherein the same can be utilized for providing convenience for the user when detaching roof shingles from a roof for collection and future disposal.

It is therefore an object of the present invention to provide a new and improved shingle removal device that has all of the advantages of the prior art and none of the disadvantages.

It is another object of the present invention to provide a means to deploy the device for removing shingles while in a fully upright and standing position.

It is another object of the present invention is to provide an inexpensive, lightweight and reusable device for the purpose of removing shingles.

It is another object of the present invention is to provide a device for the purpose of removing shingles with a replaceable blade.

It is another object of the present invention is to provide a comfortable user interface when applying the necessary sliding or downward force to remove shingles from a roof, by means of a rotatable user grip handle.

It is another object of the present invention is to provide a device for the purpose of removing shingles that utilizes freely rotating wheels to slide the blade along the roof line, decreasing the necessary force required to situate the device underneath shingles designated for removal and providing a fulcrum point from which to pry shingles away from the roof surface.

It is another object of the present invention is to provide a device for the purpose of removing shingles that utilizes a dual shaft frame for increased stability and rigidity.

It is another object of the present invention is to provide a device for the purpose of removing shingles comprising a flat blade that is attached to a dual cylindrical shaft extruding upwardly and outwardly relative to the roof line where the tool is deployed, thereby forming a fulcrum.

Yet another object of the present invention is to provide a device for the purpose of removing shingles wherein the handle is free to rotate along its own axis.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
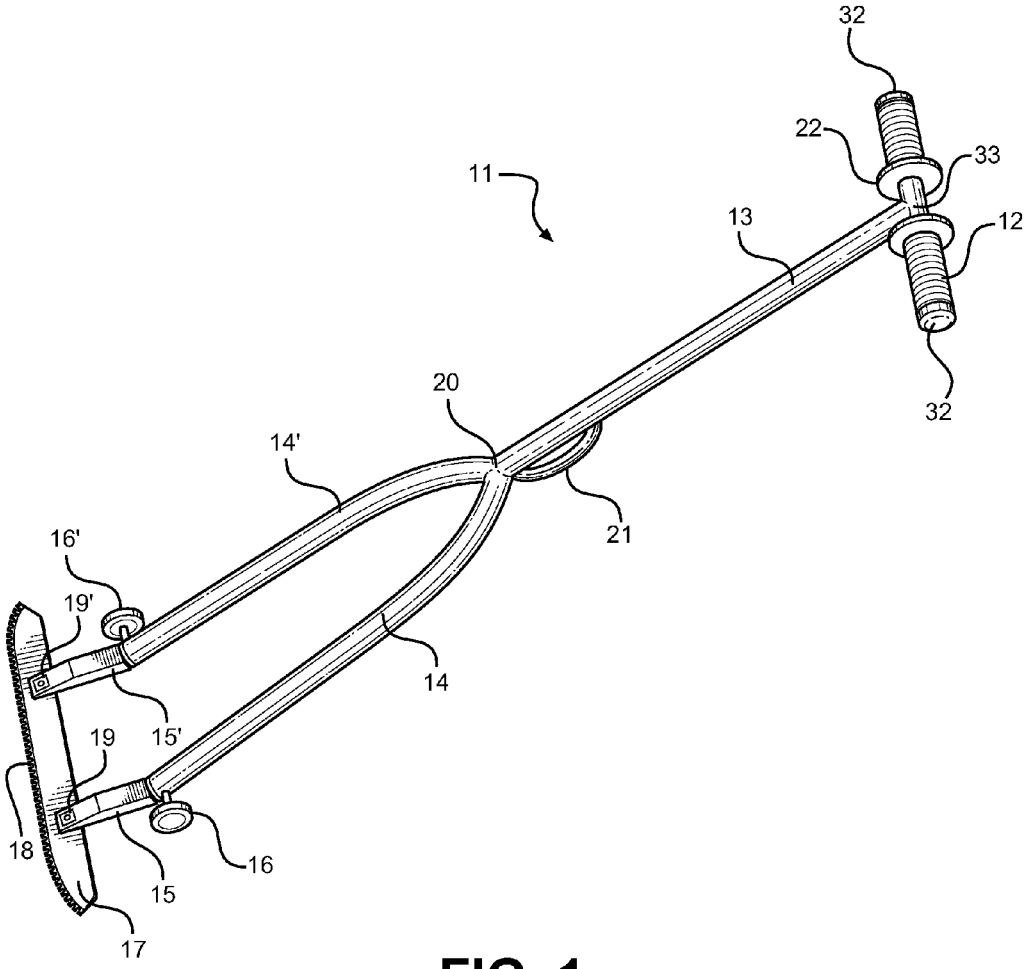
FIG. 1 shows a perspective view of the present invention.

Reference is made herein to the attached drawings. Like reference numerals are used throughout the drawings to depict like or similar elements of the shingle removal device. For the purposes of presenting a brief and clear description of the present invention, the preferred embodiment will be discussed as used for removing shingles. The figures are intended for representative purposes only and should not be considered to be limiting in any respect.

Referring now to FIG. 1, there is shown a perspective view of the shingle removal tool 11 of the present invention. The device comprises a handle end 33 orthogonally joined at its midpoint to the tool shaft 13 at its proximal end, which divides 20 into two bifurcated shafts 14 and 14' that terminate at a blade member 19 and 19' at the shaft distal end. The blade member 18 is situated at an angle relative to the axial direction of each shaft member 14, 14' such that the blade lower surface may be placed along a roof surface while the shaft 13 extends upward toward a standing user at a defined angle from the roof surface. Positioned adjacent to the blade member 18 is a first and second roller wheel 16, 16' that allows the distal end of the tool and the blade 18 to slide along the roof surface. The blade can be slid under a roof shingle, while the wheel contact point with the roof can then function as a fulcrum point for which to pry the shingle upward. The elongated shaft 13 provides leverage and mechanical advantage from the device fulcrum. The roller wheels 16 and 16' are aligned and have a common diameter. The outer diameter of the wheels is aligned with a plane defined by the blade member, such that the wheels and blade can be in simultaneous contact with a roof surface during deployment, facilitating movement of the blade therealong and under shingles to be removed.

The blade member is preferably a removable structure or one that is permanently secured to the distal end of the bifurcated tool shaft. The blade itself includes a plurality of forward notches 18 or a serrated leading edge facing the shingles during deployment. The ends of the blade 17 are preferably square with the leading edge and include a rear chamfered corner to prevent snagging. However, an exemplary embodiment as shown in FIG. 1, includes a rounded leading edge to catch off-angle shingles and reduce staging of the blade on adjacent shingles. The notches 18 facilitate the capture of roofing nails or other fasteners responsible for securing the shingles, while the removable attachment of the blade is preferably a plurality of fasteners that secure into an aperture along the distal end 19 of the first 14 and second 14' shaft.

The handle of the device includes user grips 12 positioned between end caps 32 along the exterior edge of the handle. A preferred embodiment of each grip contemplates rotatable grips that prevent rubbing and relative movement of the grips within the user's hands during sliding and lifting actions on the tool. The interior portion of the grips includes an upstanding flange 22 that prevents sliding inward of the user's hands, which is a common feature for most hand grips. Further down the shaft at the bifurcation point 20 may be positioned an external structural member 21 and reinforces this area of the shaft. The user exerts axial, shear and bending loads through the shaft proximal end during use, therefore this bifurcation point 20 is introduced to considerable stress during operation. Any weaknesses in the joint must be reinforced to prevent failure or yielding of the shaft during deployment.

Materials associated with the fabrication of the shaft, handles, grips, roller wheels and blade member are commonly known to those skilled in the art of hand tools, where necessary strength and stiffness standards must be met for reliable and efficient use in the tool intended environment. Paints, plating techniques and powder coating all offer additional means to protect the frame of the tool and increase both its longevity and structural integrity. This standard also applies to any associated hardware such as screws, nuts, washers, pins and all other fasteners utilized to assemble the tool. The material found along the exterior surfaces of both handles can be soft, elastic material to offer a comfortable user interface while being deployed, as well as a surface capable of providing enough friction for a user to maintain their grip without slippage. The wheels can be fabricated from metal, composites, plastics or other known materials that offer maximum wear resistance in order to increase their longevity due to constant abrasion while deployed. Rolling resistance is also a consideration. Wheel bearings are preferably utilized within the roller wheels to reduce mechanical wearing and drag on the wheels while in operation.

The present invention 11 is constructed using methodologies for the purpose of limiting overall weight while maintaining a rugged and durable configuration. A tubular shaft fabricated from metal will add increased rigidity to the tool and also present a light weight solution which is a critical factor for users focused on maintaining their balance while working in elevated environments. The process of welding and brazing offer both well-known and inexpensive techniques to form the frame while pipe benders are routinely utilized for shaping the desired form. These methods are prominent in the construction field however other techniques may be available to further decrease weight and increase rigidity. The shaft may alternatively be comprised of a solid material or non-metallic, as desired by the end user and his or her requirements for the tool.

Figure 2:
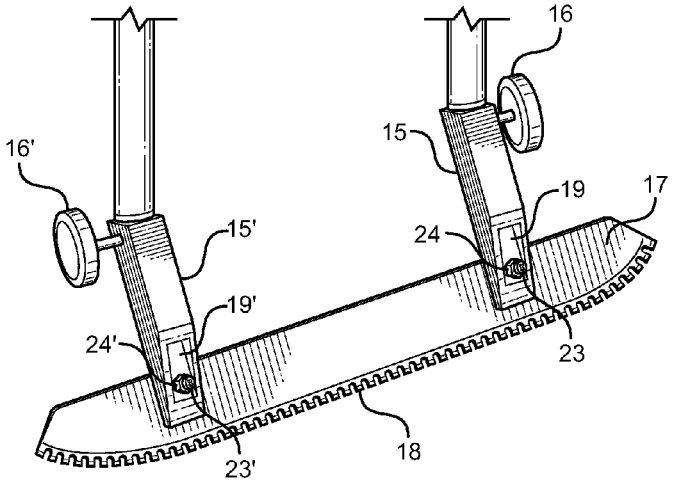
FIG. 2 shows a close up view of the present invention relating to the lower section.

Referring now to FIG. 2 there is shown a close up view of the present invention focusing on an exemplary embodiment of the shaft distal ends 19. The dual shaft frame is shown terminating at a connection with the blade member 17, whereby a hole along a flattened portion 19 of shaft lines up with a corresponding hole in the blade 17. A removable fastener 23 and 23' is then inserted into a blade aperture, passing through both holes in the tool ends until being secured by a nut 24 and 24' to make the blade removable for repair or replacement. A flat head screw combined with a countersunk hole along the underside of the blade 17 will maintain a flush underside surface, thereby eliminating any protrusions that may cause interferences during deployment. An alternate embodiment of the blade connection comprises a permanent, welded connection. This alternate provides less flexibility for the user and does not permit the user to replace worn blade members 17. Therefore the removable blade is preferred for long term use of the device without excess waste and expenditure. The roller wheels 16 and 16' adjacent to the blade 17 protrude outward from the first 15 and second 15' shaft ends. The plane of the blade member 17 intersects the wheels' outer diameter to create tangent plane, whereby the blade lower surface will be in flush contact with a support surface while both wheels are making corresponding contact with the surface. The wheels allow ready sliding of the blade 17 along the support surface, and further create a fulcrum point to lift shingles from below their structure.

Figure 3:
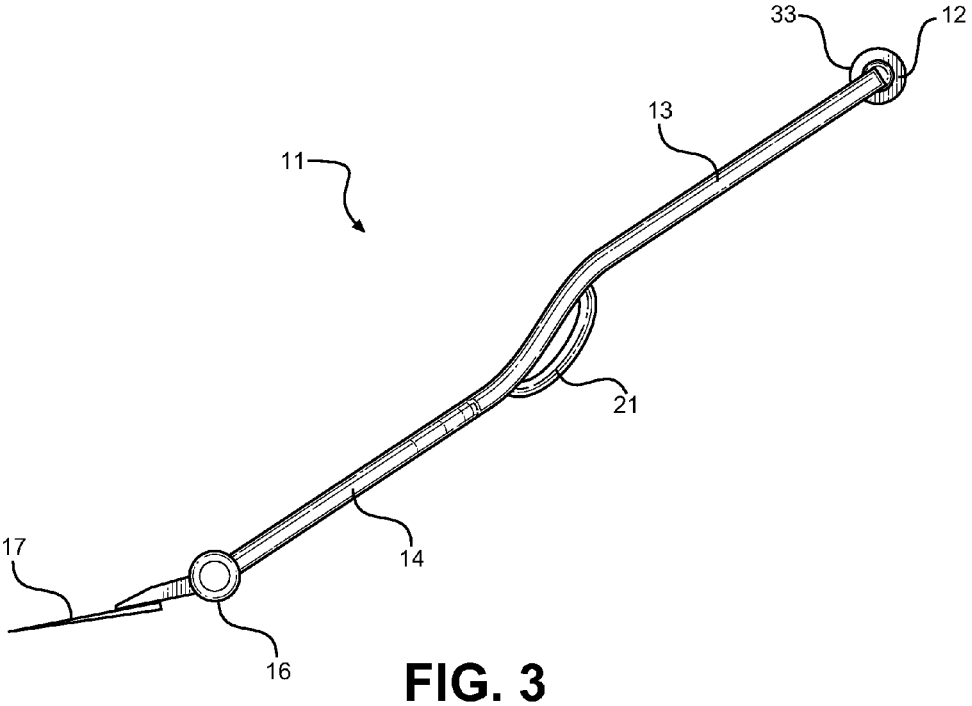
FIG. 3 shows a side view of an exemplary embodiment of the present invention.

Referring now to FIG. 3, there is shown a side view of an exemplary embodiment of the present invention 11, wherein the shaft includes an upward bend therealong. The bend may be positioned along the lower bifurcated region 14 of the shaft or along the upper portion 13. The goal is to prevent the user from leaning forward and utilized his or her back while using the tool. The upward bend offsets the axial direction established by the shaft proximal end and the shaft distal end. Also visualized is the structural reinforcement or support member 21 positioned at the bifurcation point of the tool, which prevents yielding at this location when significant load is being introduced by the user through the handle 33 and grip 12 end of the tool. Along the distal end of the tool, the underside surface of the blade member 17 is visualized, along with its relative inclination with respect to axial direction of the distal end of the tool shafts distal ends.

Several different methods can be employed to position the wheels while still maintaining their ability to rotate freely. Bearings represent the most prominent device used to provide this function, further allowing the wheels to be removable for repair or replacement. During installation, the wheels slide along the mounting cylinder until contact occurs with a flange or other mechanical stop placing the wheel at the appropriate distance from the tubular frame. The wheel is then firmly secured by either a pin inserted through both ends of the mounting cylinder on the opposite side of the wheel relative to the mechanical stop or a screw inserted into a tapped open edge of the mounting cylinder through the wheel base introducing a compressing force. Although the ideal wheel locations and mounting procedures for the present invention are described herein, suitable substitutions can be made based on either increasing the efficiency of the device or meeting additional needs of users limited only by the confines of the described scope.

Figure 4:
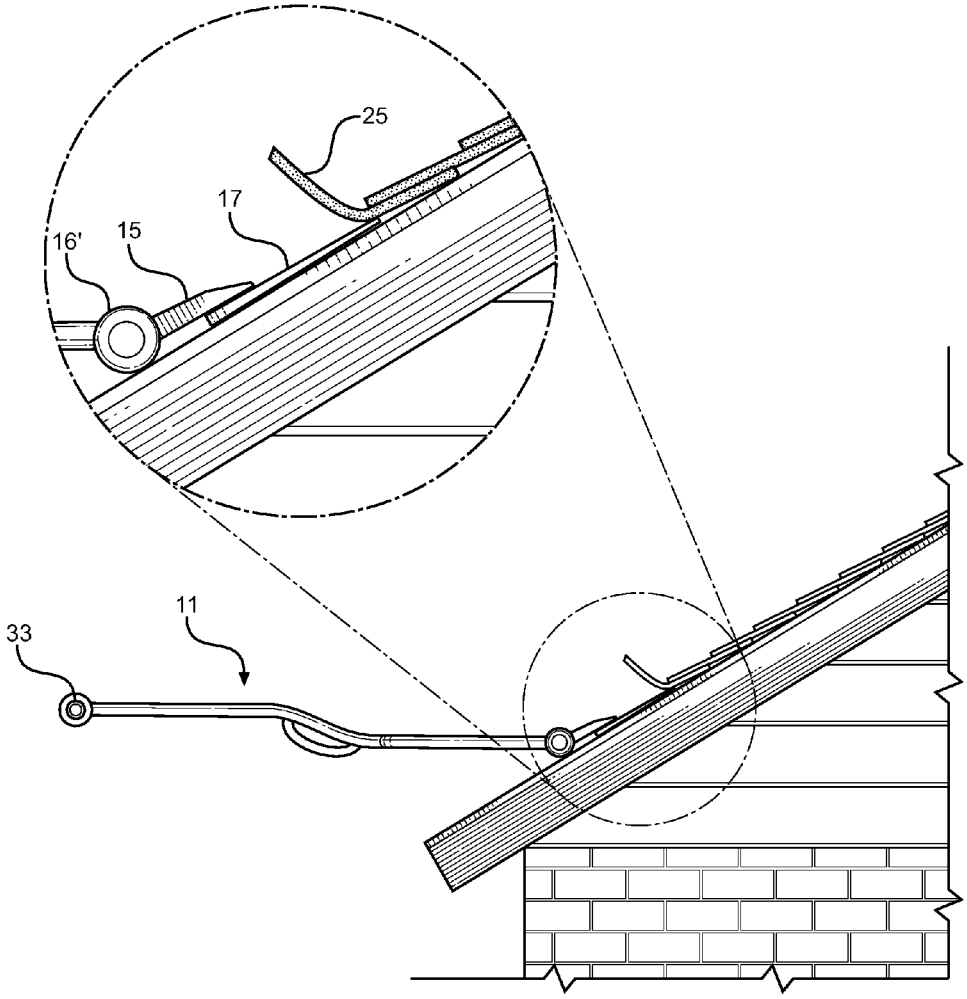
FIG. 4 shows a view of the present invention in a working position, prying shingles from the roof structure.

Referring now to FIG. 4, there is shown an view of the present invention 11 utilizing the blade 17 to supply a forward or upward force against the underside surface of a shingle 25 designated for removal, thereby lifting it from the roof structure. When deployed, the blade portion 17 of the present invention is inserted underneath a section of shingles 25 in order to unseat the fasteners that bond the shingle with the roof. The efficiency of performing this process is drastically improved through the use of wheels 16' that are found on both sections of the tool, which share the same rotational axis and allow the blade to be flush with the roof surface while sliding. These wheels reduce both friction associated with situating the device and the recurrence of hard stops. Hard stops frequently occur with current tools found in the art when a portion of the tool comes in contact with the roof causing a sudden halt of forward momentum and immediate loss of stability. A plurality of notches are found on the leading edge of the blade which comes into direct contact with the shingles to further facilitate the capture of fasteners and penetrate deeper underneath the targeted shingles providing better leverage. Once set, a downward force is applied to the handle 33, resulting in a pivot action about the roller wheel fulcrum point. The downward force being applied to the handle is then transferred into an upward force being applied to the interior surface of the shingles 25, removing them while remaining in the standing position which eliminates concerns related to physical discomfort commonly associated with continuous crouching and bending at the waist. The rotatable grips of the handle 33 allow this sliding motion or downward rotation to be accomplished with minimal wear on the user's palms. Devices that utilize stationary handles require a user to loosen their grip on the tool to allow for rotation which can detract from the overall stability required to complete the device's intended function.

Figure 5:
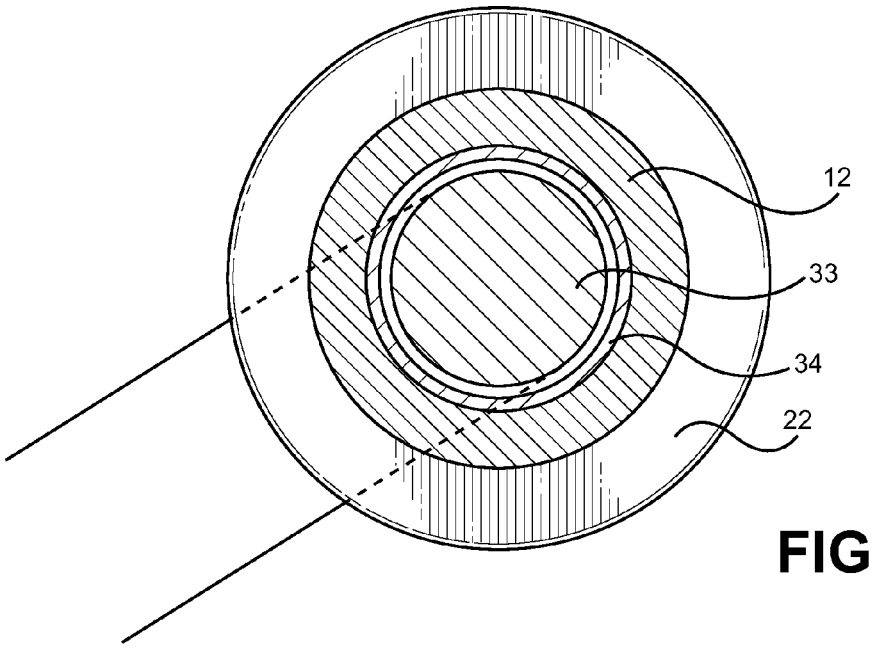
FIG. 5 shows a cross section view of an embodiment of the rotatable handle.
Figure 6:
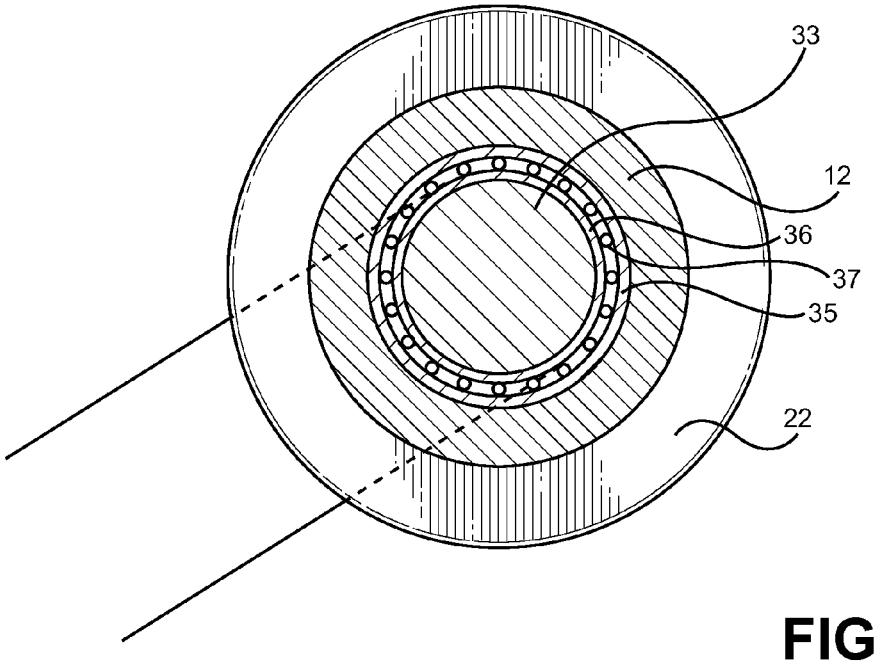
FIG. 6 shows a cross section view of another embodiment of the rotatable handle.

Referring now to FIGS. 5 and 6, there are shown two embodiments of the rotatable handle grip of the tool along its proximal end. In a first embodiment and as shown in FIG. 5, the handle grips 12 includes an interior surface or cylinder wall 34 that is concentric with the handle 33. The handle 33 and this grip interior surface 34 create concentric bodies that are capable of relative motion. A small gap between the two bodies allows the outer cylinder 34 of the grip 22 to rotate freely with respect to the handle, while end caps along the tips of the handle 33 prevent the two bodies from disconnecting. The interior edge of each handle grip comprises an upstanding grip flange 22 to protect the user's thumb and hands from contacting the tool shaft during rotation. The rotating grip by way of gapped contact is a common assembly found in motorcycle throttle grips and other similar rotatable tool grips. In an alternate embodiment of the rotatable grip, and as shown in FIG. 6, contemplates the use of a ball or roller bearing assembly between the grip 12 interior surface and the handle 33 exterior surface. The bearing includes an inner race 36 and an outer race 35 separated by bearing elements 37, which allow relative motion between the races and thus relative rotation between the grip 22 and the handle 33. This prevents binding between the two rotatable members and increases efficiency, but is a more costly embodiment over gapped contact grips. The goal of the both assemblies is to allow relative rotation of the grips about the handles such that forward and tilting motion of the tool does not generate friction on the user's hands, eliminating the need for gloves and inevitable blistering. The views of FIGS. 5 and 6 both show the handle 33 as a solid member, however the handle can also be a tubular body as well, if desired.

Figure 7:
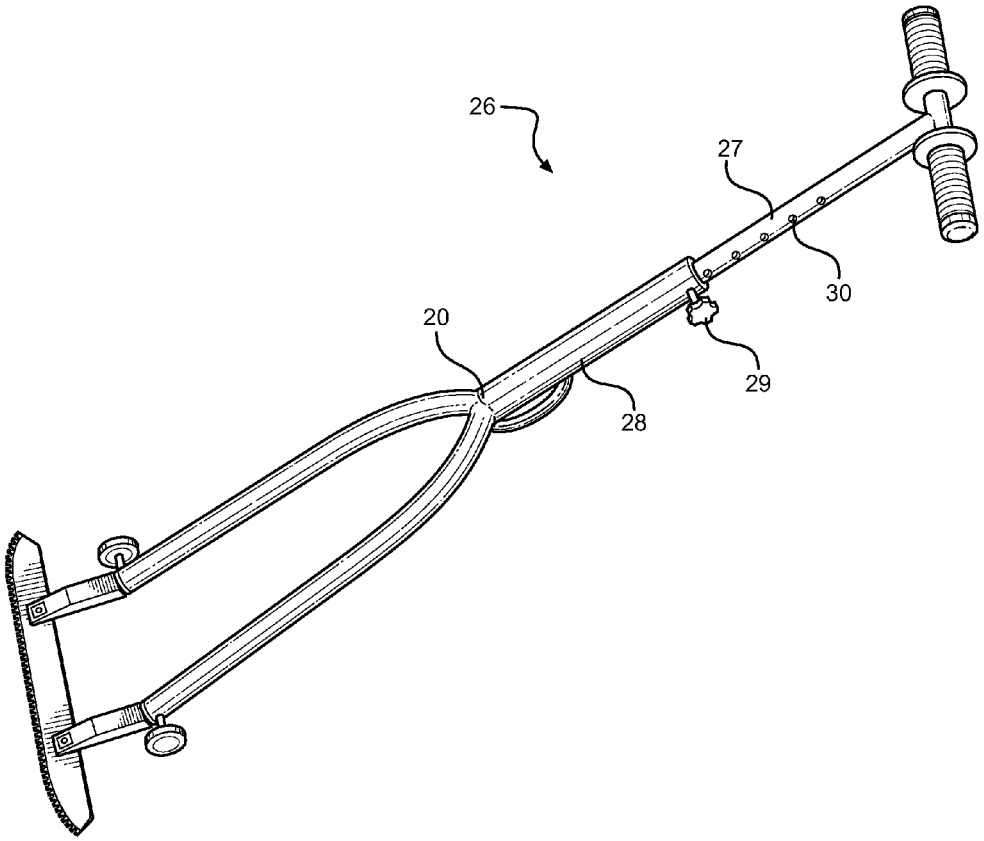
FIG. 7 shows an isometric view of the present invention with the added embodiment of an adjustable singular shaft.

Referring now to FIG. 7, there is shown a perspective view of the present invention with an additional embodiment 26 comprising a means for adjusting the singular shaft portion. The intended functionality would result from two concentric shafts that include a minimal gap between the exterior diameter of the smaller dimensioned shaft 27 and the interior diameter of the larger dimensioned shaft 28. The gap is designed to allow relative sliding of the shafts for adjusting the overall length of the tool. A spring loaded or threaded pin, controlled by a knob 29 positioned on the exterior shaft of the tool provides securement of the two shafts 27, 28 to lock the two into a permanent configuration and overall tool length. The pin is inserted through an aperture along the exterior shaft 28 and into one of a plurality of aligned apertures 30 along the interior shaft 27. Once the pin aligns with one of the plurality of incrementally-spaced apertures located on the interior shaft 27, a user rotates or releases the pin to secure the two shafts together. Alternative methods, such as compression fittings, may exist for adjusting the singular shaft and can be utilized under the assumption that they adhere to the limitations determined by the scope of the present invention.

Removing shingles and shingle nails can be a long and tedious task. If individuals attempt to pry the shingles loose with a crowbar or shingle shovel, they can end up cracking and breaking the shingles into tiny pieces, making a mess for themselves or damaging the underlying roof structure. Additionally, the removal process can require the person to bend over and sit low to the ground, which can put a lot of pressure on the person's back, legs, feet, and knees. The present invention provides a rolling blade member for forcibly removing shingles and prying them upwards through tilting motion of the tool about the roller wheel contact point with the roof. The upward bend in the shaft prevents constant bending of the user's back, while the rotatable handles reduce friction on the user's hands during use. The blade member is removable and replaceable and the structure of the shaft creates a tool for multiple uses over a prolonged period, providing a homeowner or working professional with a reliable and efficient shingle removal tool.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shingle removal device, comprising:

a bifurcating shaft having a proximal end, a distal end and a shaft bifurcation point;

said proximal end comprising a singular shaft orthogonally connecting to first and second handle;

said proximal end terminating at a first and second shaft end;

a blade member connected to said first and second shaft end;

said first and second shaft end further comprising a first and second roller wheel having a common center and equal outer diameter;

said blade member having a lower surface forming a plane tangent to said roller wheel outer diameters such that said blade lower surface and said roller wheels contact a support surface when in use.

2. The device of claim 1, wherein said blade member connection to said first and second shafts orients said blade member at an angle relative to an axial direction established by said shaft distal ends.

3. The device of claim 1, where said aligned roller wheels provide a fulcrum point, whereby downward motion of said shaft proximal end creates upward motion of said blade member, and vise versa.

4. The device of claim 1, wherein said shaft further comprises an upward bend that offsets said an axial direction established by said shaft proximal end and said shaft distal end.

5. The device of claim 1, wherein said blade member is removably connected to said shaft distal ends.

6. The device of claim 1, wherein said bifurcation point further comprises a reinforcement member to prevent material yielding.

7. The device of claim 1, wherein said shaft is length adjustable.

8. The device of claim 7, wherein said length adjustable shaft comprises a first and second concentric shaft slideably adjustable with respect to one another and securable into a static configuration.

9. The device of claim 1, wherein said handle further comprises grip members.

10. The device of claim 1, wherein said handle further comprises rotatable grip members.

11. The device of claim 10, wherein said rotatable grip members further comprise an interior surface adapted to rotate about said handle, said handle having an end comprising an end cap to prevent said grip from disconnecting from said handle and said grip interior surface having a minimal gap to allow relative rotation with respect to said handle.

12. The device of claim 10, wherein said rotatable grip members further comprise an interior surface separated from said handle exterior surface by a rotatable bearing assembly.

13. The device of claim 1, wherein said shaft is a hollow and tubular member.

* * * * *